US009662849B2

(12) United States Patent
Le Palud et al.

(10) Patent No.: US 9,662,849 B2
(45) Date of Patent: May 30, 2017

(54) BIN FOR A RUBBISH COLLECTION VEHICLE WITH IMPROVED COMPACTION

(71) Applicant: PB ENVIRONNEMENT, Lambesc (FR)

(72) Inventors: Frédéric Le Palud, Vitrolles (FR); Philippe Quarteroni, Lancon de Provence (FR); Christian Reverdy, La Ciotat (FR)

(73) Assignee: PB ENVIRONMENT, Lambesc (FR)

( * ) Notice: Subject to any disclaimer, the term of this patent is extended or adjusted under 35 U.S.C. 154(b) by 0 days.

(21) Appl. No.: 14/646,181

(22) PCT Filed: Nov. 13, 2013

(86) PCT No.: PCT/FR2013/052720
§ 371 (c)(1),
(2) Date: May 20, 2015

(87) PCT Pub. No.: WO2014/080106
PCT Pub. Date: May 30, 2014

(65) Prior Publication Data

US 2015/0314959 A1 Nov. 5, 2015

(30) Foreign Application Priority Data

Nov. 20, 2012 (FR) ..... 12 61011

(51) Int. Cl.
*B30B 9/30* (2006.01)
*B65F 3/20* (2006.01)
(Continued)

(52) U.S. Cl.
CPC ..... *B30B 9/3057* (2013.01); *B30B 9/3046* (2013.01); *B65F 3/00* (2013.01);
(Continued)

(58) Field of Classification Search
CPC ... B30B 9/3042; B30B 9/3046; B30B 9/3057; B30B 9/3082; B65F 3/143; B65F 3/14;
(Continued)

(56) References Cited

U.S. PATENT DOCUMENTS 3,410,427 A * 11/1968 McCarthy ..... B65F 3/205 100/264
3,881,613 A * 5/1975 Torimoto ..... B65F 3/143 414/498

(Continued)

FOREIGN PATENT DOCUMENTS

EP 0514355 A1 11/1992
EP 1028072 A1 8/2000

(Continued)

*Primary Examiner* — Jimmy T Nguyen
(74) *Attorney, Agent, or Firm* — Jordan IP Law, LLC; Todd A. Vaughn

(57) ABSTRACT

A system for compacting rubbish, including a frame having a front wall, a carrier to be moved in a forwards-backwards direction relative to the frame, an upper scoop pivotably mounted on the carrier about a first horizontal axis and having an upper face for milling rubbish, and a lower scoop pivotably mounted on the upper scoop about a second horizontal axis, and having a lower milling face rubbish. The upper and lower scoops are to take a downwardly deployed position when their respective milling faces face the front wall. The carrier is to be moved forwards when the upper and lower scoops are in deployed position, in such a way as to compact the rubbish between the milling faces and the front wall. In the deployed position, a projection of the upper milling face in a transverse plane has a surface greater than or equal to a projection of the lower milling face in the transverse plane.

17 Claims, 9 Drawing Sheets

(51) Int. Cl.
*B65F 3/00* (2006.01)
*B65F 3/04* (2006.01)
*B65F 3/02* (2006.01)

(52) U.S. Cl.
CPC ..... *B65F 3/045* (2013.01); *B65F 3/046* (2013.01); *B65F 3/201* (2013.01); *B65F 3/207* (2013.01); *B65F 3/208* (2013.01); *B65F 2003/006* (2013.01); *B65F 2003/024* (2013.01)

(58) Field of Classification Search
CPC .. B65F 3/20; B65F 3/205; B65F 3/208; B65F 3/207; B65F 3/201; B65F 3/26; B65F 2003/006; B65F 2003/008
USPC ..... 100/233; 414/525.55, 525.54, 525.5, 414/525.4, 525.3, 525.6, 525.51, 812, 813
See application file for complete search history.

(56) References Cited

U.S. PATENT DOCUMENTS

| | | | | |
|---|---|---|---|---|
| 5,029,522 | A * | 7/1991 | Brisson | B30B 9/3014 100/218 |
| 5,076,159 | A * | 12/1991 | Vedeo | B30B 9/3046 100/233 |
| 2004/0091345 | A1 | 5/2004 | Flerchinger | |
| 2010/0089259 | A1 * | 4/2010 | Hallman | B30B 9/3039 100/188 R |

FOREIGN PATENT DOCUMENTS

| | | | |
|---|---|---|---|
| EP | 2228322 | A1 | 9/2010 |
| EP | 2366639 | A1 | 9/2011 |
| EP | 2384999 | A1 | 11/2011 |

* cited by examiner

BIN FOR A RUBBISH COLLECTION VEHICLE WITH IMPROVED COMPACTION

CROSS-REFERENCE TO RELATED APPLICATIONS

The present application is a National Stage Application of PCT International Application No. PCT/FR2013/052720 (filed on Nov. 13, 2013), under 35 U.S.C. §371, which claims priority to French Patent Application No. A 1261011 (filed on Nov. 20, 2012), which are each hereby incorporated by reference in their respective entireties.

TECHNICAL FIELD

The invention relates to the field of rubbish collection vehicles (RCVs), i.e., vehicles used for collecting and transporting rubbish (for example, household waste, bulky waste, recyclable waste) of which the loading is carried out either by rubbish containers, or by hand. An RCV comprises a chassis-cab whereon a superstructure is mounted; this superstructure comprises a caisson for collecting rubbish. More particularly, the invention relates to a new mechanism for compacting (or compaction) for rubbish intended for rear-loaded RCVs. It also relates to a method for compacting that uses this new mechanism, and a rubbish collection vehicle provided with this new mechanism.

BACKGROUND

Rubbish collection vehicles (RCVs) with rear loading are the subject of European standard EN 1501-1 (2011) "Refuse collection vehicles—General requirements and safety requirements—Part 1: Rear loaded refuse collection vehicles."

In general, RCVs are based on a standard chassis-cab, whereon is adapted the superstructure including the caisson provided with a mechanism for compacting rubbish. These chassis-cabs are often designed for a substantial gross vehicle weight rating (GVWR), for example from 12 to 26 tons; knowing that each emptying of the RCV interrupts the collection circuit, it is always sought to increase the capacity of the RCV and its GVWR in order to decrease the frequency of the emptying, while still ensuring the navigability of the RCV in the streets in which the collection is carried out.

Many mechanisms for compacting for such vehicles are known.

European Patent Publication No. EP 0514355 B1 (Farid Industrie) describes a device with a mobile plate fixed to a telescopic device that compacts the rubbish in a vehicle; this compacting is low. European Patent Publication No. EP 0637555 B1 (Valle Teiro Eurotec) describes an articulated compacting scoop of which the displacement is provided by a hydraulic cylinder and connecting rod system. Patent application French Patent Publication No. FR 2945284 A1 (Gillard) describes another system for compacting with an articulated scoop.

U.S. Pat. No. 5,076,159 and European Patent Publication No. EP 0463189 B1 (Valle Teiro) describe articulated compacting scoops on arms mounted rigidly or slidingly on a mobile carrier. European Patent Publication No. EP 0659659 A1 (CEB Costruzioni Ecologiche Bergomi) describes a compacting scoop which is displaced over a cylinder and of which the length can by adjusted by cylinder. This system is flexible and mobile but heavy.

From European Patent Publication No. EP 2366639 A1 (Tecme) is known a caisson with a compaction device comprising an articulated scoop and moved by a mechanism comprising a connecting rod. The articulated scoop comprises an upper scoop pivotably mounted on the caisson about a first right-left axis and having an upper face for milling rubbish, and a lower scoop pivotably mounted on the upper scoop about a second right-left axis, and having a lower face for milling rubbish. In the deployed position, the faces for milling face a front apron, said front apron being mounted slidingly on the caisson and intended to be displaced at the rear in order to move closer to the lower and upper scoops, when the latter are in deployed position, in order to compact the rubbish by pressing it against the milling surface of the scoop. Moreover, during the emptying of the caisson, the rear apron is used as a gland to effectively remove the rubbish through the rear despite the substantial change in slope (of about 40°) provided at the rear of the bottom of the caisson. The presence of the rear apron has the disadvantage of adding substantial weight to the caisson.

European Patent Publication No. EP 2384999 A1 (Novarini) describes a frame provided with an articulated scoop with cylinders, mounted on a carrier intended to be moved in a forwards-backwards direction relative to the caisson. The compaction of the rubbish is done between the thrust surfaces of the deployed upper and lower scoops and the front wall of the frame. The frame is a caisson of a rubbish collection vehicle.

However, as the angle of rotation of the upper scoop is very low, the upper scoop does not contribute to the compacting of the rubbish, but is substantially used to put the lower portion of the scoop into compacting position. It is, therefore, the lower scoop which is sized to carry out the compacting. As such, the lower scoop is of substantial dimensions, as well as the cylinders actuating it. The ensemble therefore has a substantial weight.

The applicant has found that the compacting systems according to prior art are not optimized for small-size RCVs. Indeed, next to large-size RCVs, there is a real need for RCVs with a more reduced size. This need exists in particular for small municipalities, or in municipalities that have narrow and/or sloped streets, for example in mountain villages.

The applicant has observed that the devices of prior art have disadvantages when it is sought to use them for light RCVs, which are of reduced size, volume and weight. A disadvantage is that they do not allow for compacting that is sufficiently effective. Another disadvantage is that they are too heavy relative to the carrying capacity of the caisson. Indeed, during the designing of a light RCV, for example, of an RCV comprising a superstructure mounted on a standard chassis-cab designed for a GVWR of 7.5 or of 9 t, the weight of the superstructure must be reduced as much as possible in order to increase the carrying capacity of the caisson relative to the GVWR. This carrying capacity of the caisson depends, on the one hand, on its volume, and on the other hand, on the compacting capacity of the compacting system. The third factor that determines the sizing is the stability constraint of the RCV in all circumstances.

SUMMARY

The problem that this invention seeks to resolve is therefore to provide a compacting mechanism for an RCV that is effective but light, and which is particularly adapted to the caissons of light RCVs, i.e. with a GVWR that does not exceed 10 t, and more preferably that does not exceed 7.5 t.

A first purpose of the invention is to provide a compacting mechanism for an RCV with rear loading that allows for improved compacting, without increasing the weight of the superstructure.

Another purpose of the invention is to provide a compacting mechanism for RCV with read loading that does not hinder the emptying of the caisson by tipping.

Another purpose of the invention is to provide a caisson for an RCV with rear loading provided with an improved compacting mechanism, which, thanks to a judicious adaptation of one to the other, allows for a more effective compacting, without increasing the weight of the superstructure.

Another purpose of the invention is to provide a caisson for an RCV with rear loading, provided with an improved compacting mechanism, which can be mounted on a standard truck chassis with a GVWR less than or equal to 10 t, and more preferably with a GVWR of 9 t or of 7.5 t.

Yet another purpose of the invention is to provide a caisson for an RCV with rear loading provided with an improved compacting mechanism, which, thanks to a judicious adaptation of one to the other, allows for emptying by tipping while still providing a perfect stability of the RCV.

Yet another purpose is to propose an improved method for compacting the rubbish in an RCV.

Yet another purpose is to propose an improved method for emptying by tipping an RCV.

These purposes are achieved by the subjects of this invention. In order to overcome at least partially the disadvantages of the known compacting systems, a system for compacting rubbish is proposed comprising a frame comprising a front wall, a carrier intended to be moved in a forwards-backwards direction relative to the frame, an upper scoop pivotably mounted on the carrier about a first right-left axis, called the axis A1, and having an upper face for milling rubbish, and a lower scoop pivotably mounted on the upper scoop about a second right-left axis, called the axis A2, and having a lower face for milling rubbish, said upper and lower scoops being intended to assume a downwardly deployed position wherein their milling surfaces face the front wall; said carrier being intended to be moved forwards when the upper and lower scoops are in deployed position, in such a way as to compact the rubbish between the faces for milling and the front wall; said system for compacting being characterized in that, in the deployed position, the projection of the upper milling face in the plane perpendicular to the forwards-backwards direction, called the transverse plane, has a surface greater than or equal to the projection of the lower milling face in the transverse plane.

Thanks to this invention, the upper scoop contributes fully to the compacting contrary to the upper scoop of European Patent Publication No. EP 2384999 A1 wherein its small size and its low inclination in the deployed position do not allow it any contribution to compacting other than anecdotal. The fact that the upper scoop contributes fully to the compacting makes it possible to reduce the size and the weight of the lower scoop. Furthermore, the presence of a sliding front apron is avoided, which makes it possible to reduce the weight of the compacting system.

The compacting system according to the invention can be carried out in such a way that, in the deployed position, the projection of the upper milling face in the transverse plane has a surface between one and one and a half times the surface of the projection of the lower milling face in the transverse plane.

In an embodiment, the upper milling face has a surface greater than or equal to the lower milling face; this surface is advantageously between one and one and a half times the lower milling face.

If the milling surface of the lower scoop is excessively small, it can no longer effectively fulfill its role which consists in sweeping the deepest or farthest volume of the caisson. If it is excessively large, the contribution of the upper scoop to the compacting is not optimal.

In another embodiment, which can be combined with the other embodiments, the upper scoop is designed in such a way as to be able to take a position wherein the axis A2 is pivoted about the axis A1 by an angle $\gamma$ (gamma) relative to the forwards-backwards direction, positive upwards and negative downwards, said angle gamma being greater than or equal to $-25°$, and wherein, in the high position of the lower scoop, the rear end of the lower milling face is pivoted by an angle $\alpha$ (alpha) relative to the plane defined by the axes A1 and A2, positive upwards and negative downwards, with the angle alpha being greater than or equal to 0°, and more preferably between 20° and 40°, and even more preferentially between 25° and 35°. Advantageously, the lower scoop can travel, from abutment to abutment, an angle of at least 75°, and more preferably of at least 80°.

The displacement of the carrier can be provided by at least one actuating cylinder of the carrier having a rear end fixed to the rear of the carrier and a front end intended to be fixed to the frame, in front of the carrier.

The compacting system according to the invention advantageously comprises at least one actuating cylinder of the upper scoop having a front end pivotably mounted on the carrier about a third right-left axis, called the axis A3, higher according to a bottom-top direction than the axis A1, and a rear end pivotably mounted on the upper scoop about a fourth right-left axis, called the axis A4, higher according to the bottom-top direction than the axis A2.

The compacting system advantageously comprises at least one actuating cylinder of the lower scoop having a front end pivotably mounted on the upper scoop about a fifth right-left axis, called the axis A5, higher according to the bottom-top direction than the axis A2 and located to the front of the axis A4, and a rear end pivotably mounted on the lower scoop about a sixth right-left axis, called the axis A6.

Advantageously, the carrier, the upper scoop and the lower scoop are made from more than 95% by weight of aluminum, except for the cylinders and their arms and axes of rotation. Advantageously, the caisson is made from more than 95% of aluminum, except for the cylinders and their arms, the axes of rotation, the attachment points and the manual means for locking the swing gate. Preferably, the lateral walls are made from double-skin aluminum profiles, the bottom of the caisson is made of aluminum sheet metal (possibly reinforced underneath with aluminum profiles), and the caisson is edged with an aluminum peripheral profile.

Another object of the invention is a rubbish collection vehicle, comprising a caisson intended to store the rubbish, the caisson comprising a front wall, and said vehicle comprising a system for compacting the rubbish stored in the caisson according to the invention, wherein the frame is formed by the caisson.

Said caisson comprises two lateral walls having at their top respectively two sliding members wherein the carrier is intended to slide.

According to an advantageous embodiment, the carrier comprises a plurality of shoes, and more precisely comprises on each side at least one bearing shoe, more preferably at least one at the top and at least one at the bottom, and at least one lateral guide shoes fixed to the carrier and intended to cooperate with the frame in order to guide the carrier in its movement and in order to prevent a binding of this forwards-backwards displacement. Each shoe slides over a surface of one of the sliding members.

In an advantageous embodiment of the rubbish collection vehicle according to the invention, said caisson comprises a bottom having a central portion and a rear portion inclined in such a way as to start from the central portion and to rise towards the rear. Advantageously, the rear portion is inclined by at least 12° and at most 25°, and even more advantageously this angle of inclination relative to the horizontal is between 17° and 23°. A value of 20° is very advantageous. The bottom of the caisson comprises a front portion inclined in such a way as to start from the central portion and to rise towards the front.

Yet another object of the invention is a method for compacting rubbish that uses a rubbish collection vehicle according to the invention, comprising: (a) the placing of the carrier, of the upper scoop and of the lower scoop in a cleared position, wherein the carrier is in a rear position, the upper scoop is in a high position relative to the carrier, and the lower scoop is in a high position relative to the upper scoop; (b) the pivoting of the lower scoop from its high position to its low position; (c) while the lower scoop is in its low position, the pivoting of the upper scoop from its high position to its low position, in such a way that the upper and lower scoops are in the downwardly deployed position; and (d) while the upper and lower scoops are in the downwardly deployed position, the displacement of the carrier to a front position.

According to the level of filling of the caisson with rubbish to be compacted, the compacting can take place during the steps (b), (c) and/or (d).

This sequence can be executed in a strictly sequential manner, wherein the completion of a step triggers the starting of the step. By way of example, the lower abutment of the lower scoop at the end of the step (b) can trigger, provided there is a suitable hydraulic automatism, the start of the step (c), namely the closing of the upper scoop. This sequence can also be carried out in such a way that two successive steps overlap partially.

In an embodiment of this method, in the high position of the upper scoop, the axis A2 is pivoted about the axis A1 by an angle gamma relative to the forwards-backwards direction, positive upwards and negative downwards, with the angle gamma being greater than or equal to −25°, and wherein, in the high position of the lower scoop, the rear end of the lower milling face is pivoted by an angle gamma relative to the plane defined by the axes A1 and A2, positive upwards and negative downwards, with the angle alpha being greater than or equal to 0° and more preferably between 20° and 40°, and even more preferentially between 25° and 35°.

In another embodiment which can advantageously be combined with the preceding one, the upper scoop is intended to take a position wherein the axis A2 is pivoted about the axis A1 by an angle beta relative to the forwards-backwards direction, positive upwards and negative downwards, with the angle beta being less than or equal to −50° and more preferably to −55°.

Advantageously, the method is conducted in such a way that, during the pivoting of the upper scoop, the lower scoop borders the rear portion of the bottom of the caisson by remaining at least 60 cm, but at most 10 cm from this rear portion. Likewise, advantageously, the method is conducted in such a way that, during the pivoting of the upper scoop, the lower scoop moves closer to the bottom at a distance between 10 and 40 cm. If this distance is too great, a portion of the rubbish is not compacted. If it is too small, there is a risk that the scoop catches non-compressible and dense objects (such as stones, foundry parts (such as motor casings), various metal parts) and draws them frontwards, damaging the surface of the bottom of the caisson.

DEFINITIONS

"Rubbish collection vehicle (RCV)" means a vehicle used to collect and transport rubbish (for example, household waste, bulky waste, recyclable waste of which the loading is carried out either by rubbish containers, or by hand. An RCV comprises a chassis-cab whereon a superstructure is mounted.

"RCV with rear loading" means an RCV in which the rubbish is loaded into the caisson from the rear.

"Caisson" means the portion of the superstructure in which the rubbish collected is transported.

"Cab" means an enclosure mounted on the chassis at the front of the superstructure and which shelters the driving position of the RCV with rear loading.

"Superstructure" means the assembly of all of the components fixed on the chassis-cab of the RCV and including the caisson.

"Capacity of the RCV" means the internal volume available for the rubbish.

"Compacting mechanism" means the mechanism that makes it possible to compact and/or transfer the rubbish in the caisson.

"Unloading system" means the mechanism and the movement that makes it possible to empty the caisson.

"Tipping system" means a means for emptying the caisson by tipping it.

"Container lifter" (*) here means a mechanism fixed onto an RCV for the loading of rubbish in son caisson.

"Container lifter for rubbish containers" means a mechanism installed on an RCV for the emptying of the rubbish containers provided.

"Built-in rubbish container lifter" (*) means a container lifter for rubbish containers designed to be permanently fixed on the caisson of the RCV.

"Grasping system" (*) means the portion or portions of the container lifter intended to be in contact with the rubbish container in order to receive its corresponding portion for the purposes of grasping, lifting and emptying.

"Comb grasping system" (*) means a horizontal row of teeth directed upwards and a system for locking intended to retain, during the emptying, the rubbish container.

"Functional zone" (*) means the space covered by the movements of the container lifter and of the rubbish container or containers provided when they are lifted by a container lifter.

"Rubbish container emptying cycle" means the succession of sequences required to grasp, lift, tip and empty the rubbish container provided and to set it back on the ground.

These definitions come from European standards EN 1501-1 (2011) or (*) EN 1501-5 (2011), known to those skilled in the art.

"Loader" means a refuse worker working behind the vehicle. The term "aluminum" includes aluminum alloys.

DRAWINGS

FIG. 1 shows a perspective view of a rubbish collection vehicle according to the invention.

FIG. 2 shows a perspective view of the caisson of the rubbish collection vehicle according to the invention, with the lateral right wall removed.

FIG. 3 shows a cross-section view of the caisson according to the invention with the compacting mechanism according to the invention, in which a lateral surface is swept by a scoop in the compacting cycle.

FIG. 4 shows a cross-section view of the caisson according to the invention with the compacting mechanism according to the invention, including a position of the upper and lower scoop in deployed position.

Figure 5A:
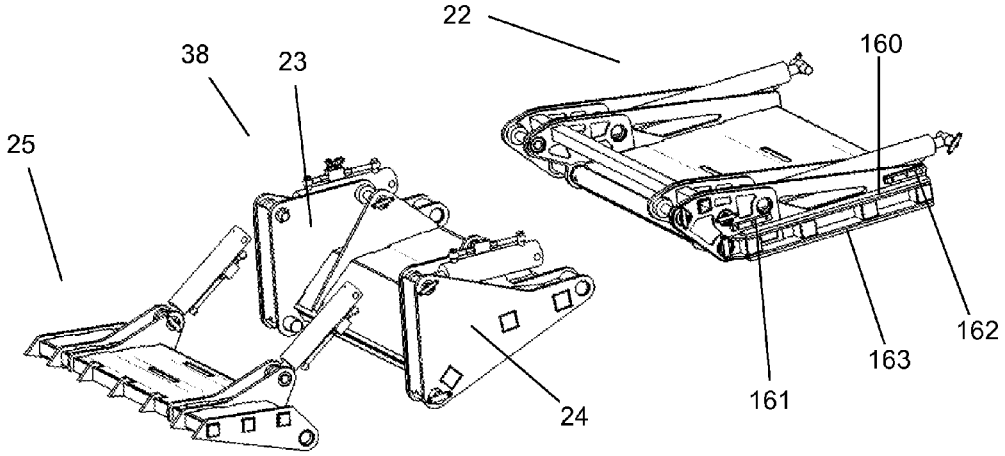
Figure 5B:
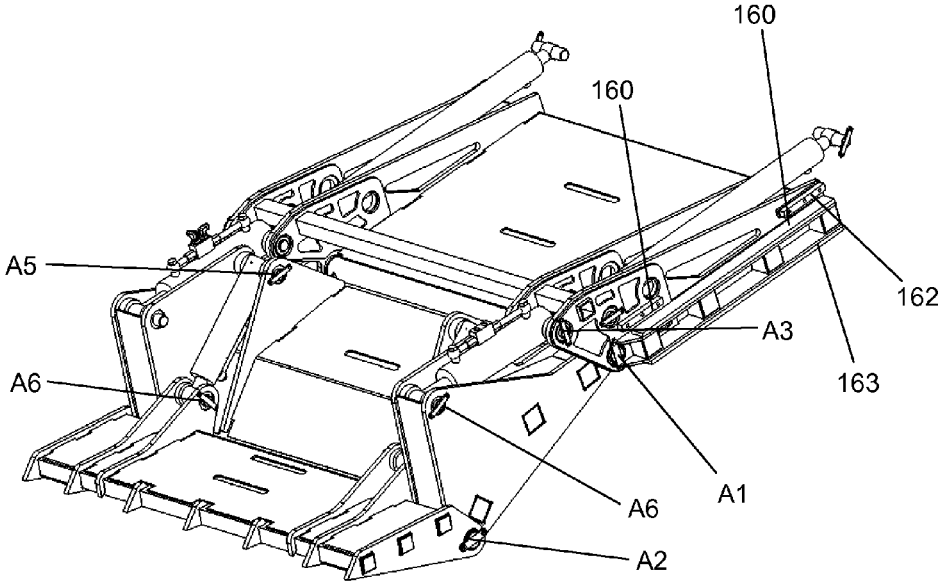

FIGS. 5*a* and 5*b* shows the compacting mechanism according to the invention, as an exploded view (FIG. 5*a*) and assembled view (FIG. 5*b*).

FIGS. 6*a* to 6*h* show a full compacting cycle.

Figure 7A:
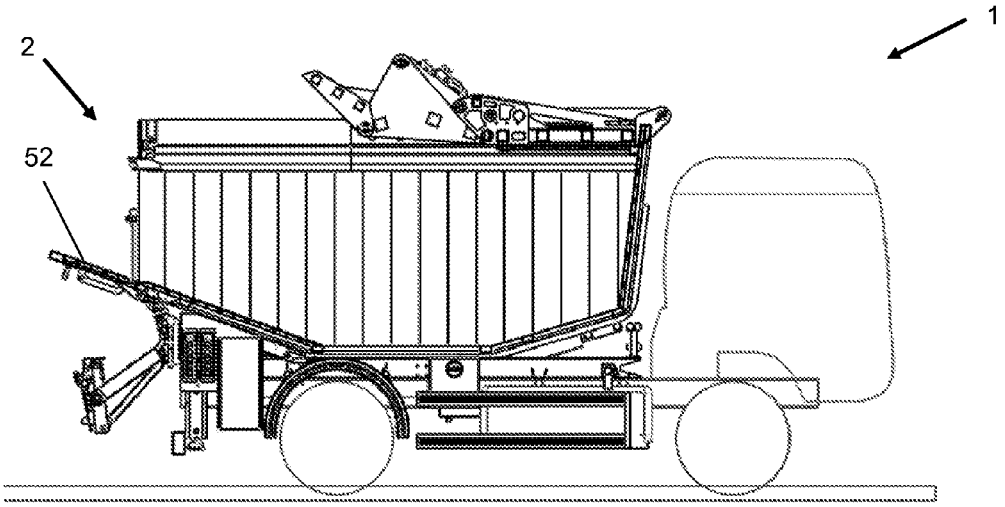
Figure 7B:
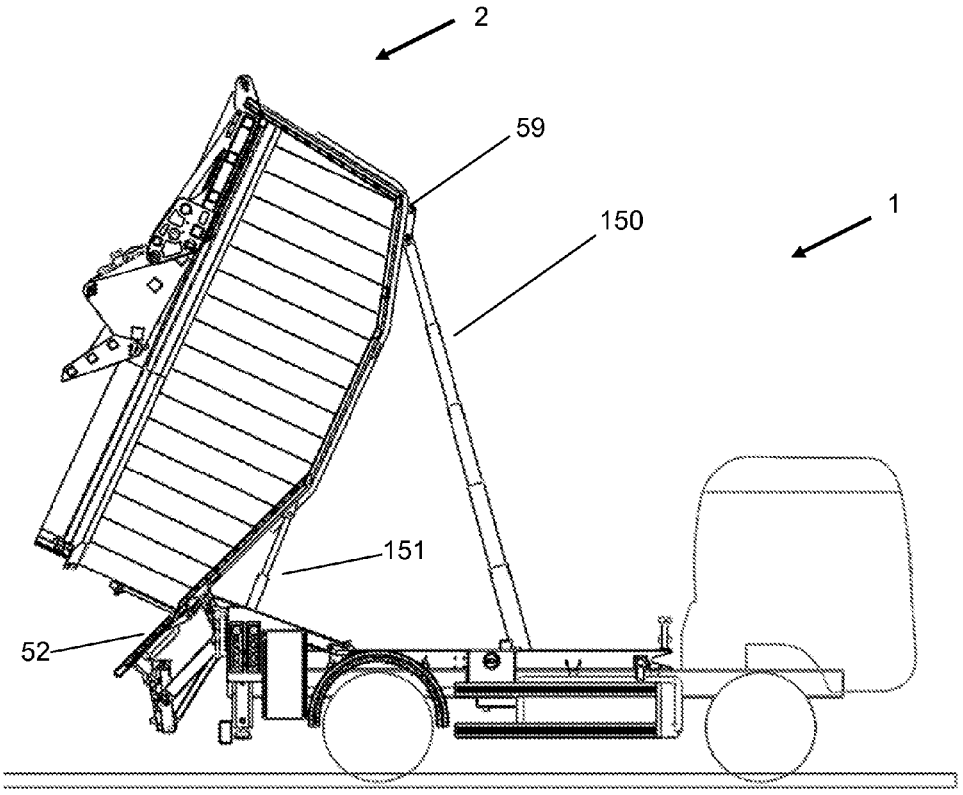

FIGS. 7*a* and 7*b* show the emptying of the caisson. FIG. 7*a* shows a position of the compacting mechanism for preparing the emptying, while FIG. 7*b* shows a tipping of the caisson during the emptying.

Figure 8:
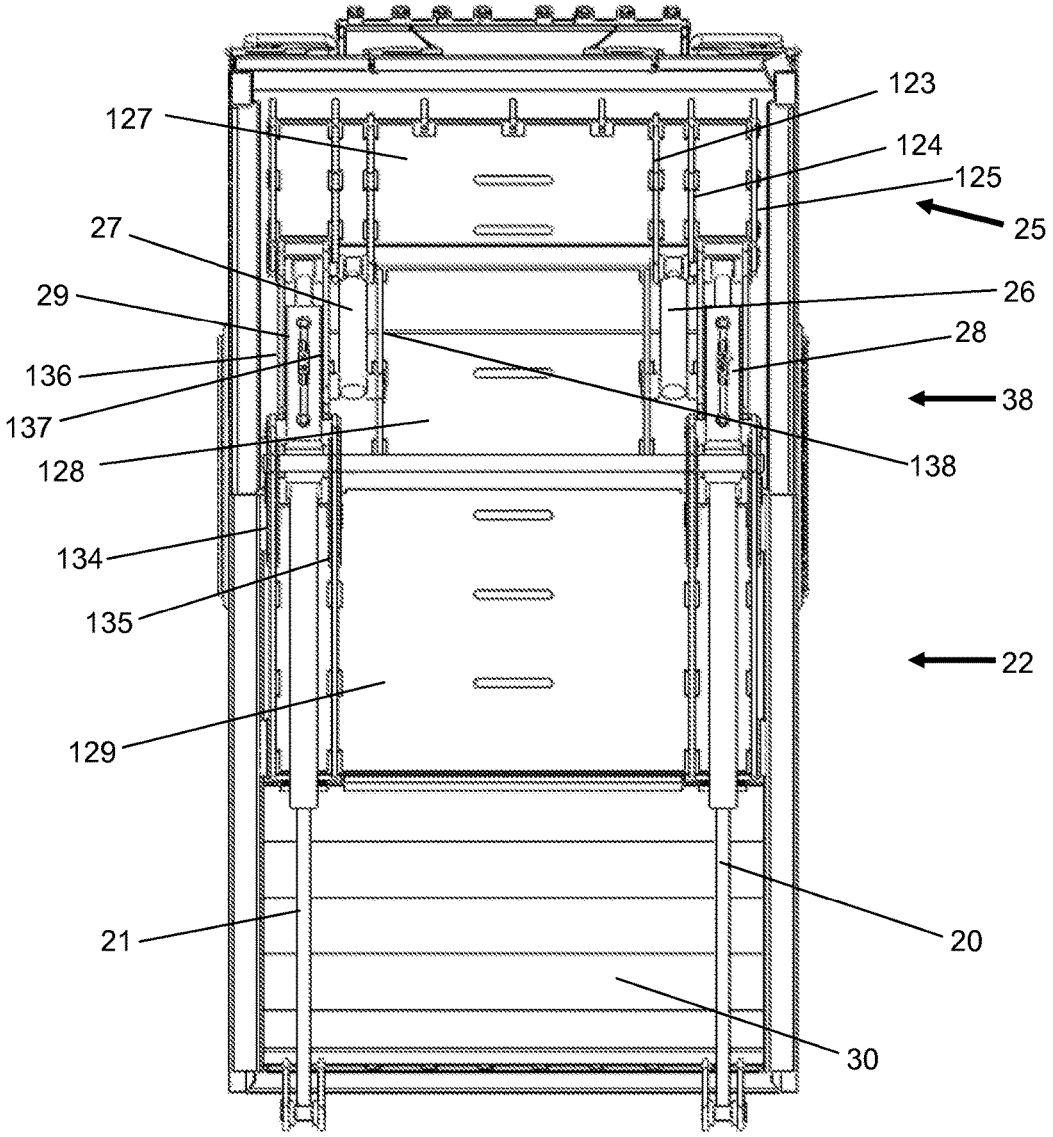

FIG. 8 shows a top view of the compacting mechanism.

Figure 9:
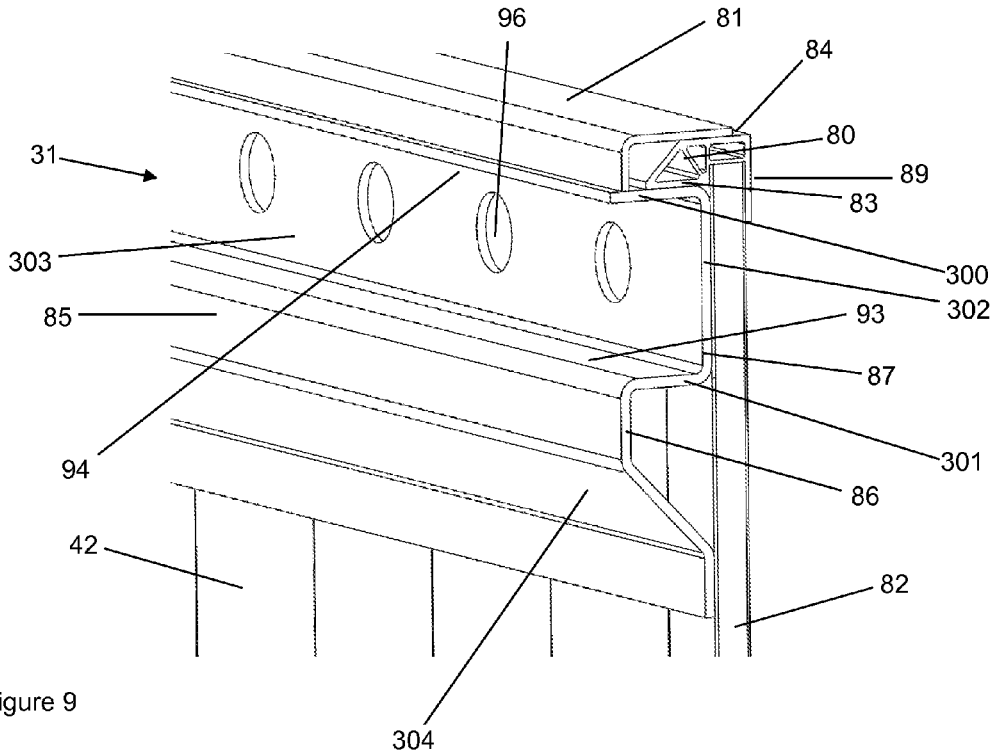

FIG. 9 shows an enlargement of the upper portion of the caisson, in order to show in particular the sliding member wherein the carrier of the compacting mechanism according to the invention is intended to slide.

Figure 10:
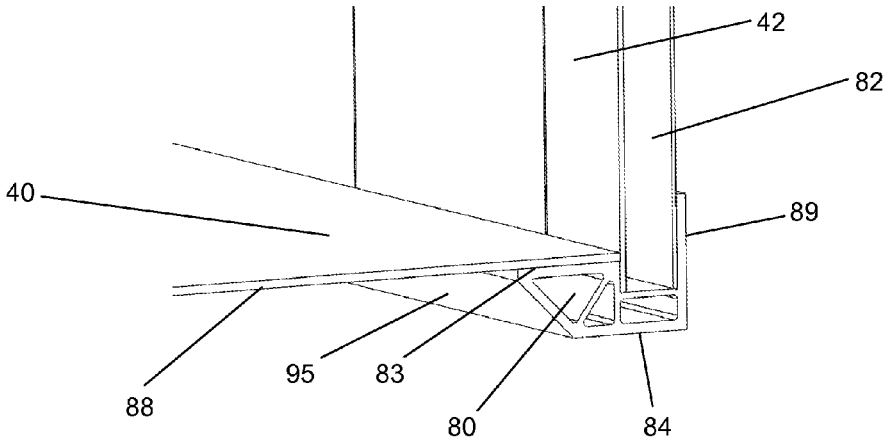
Figure 11:
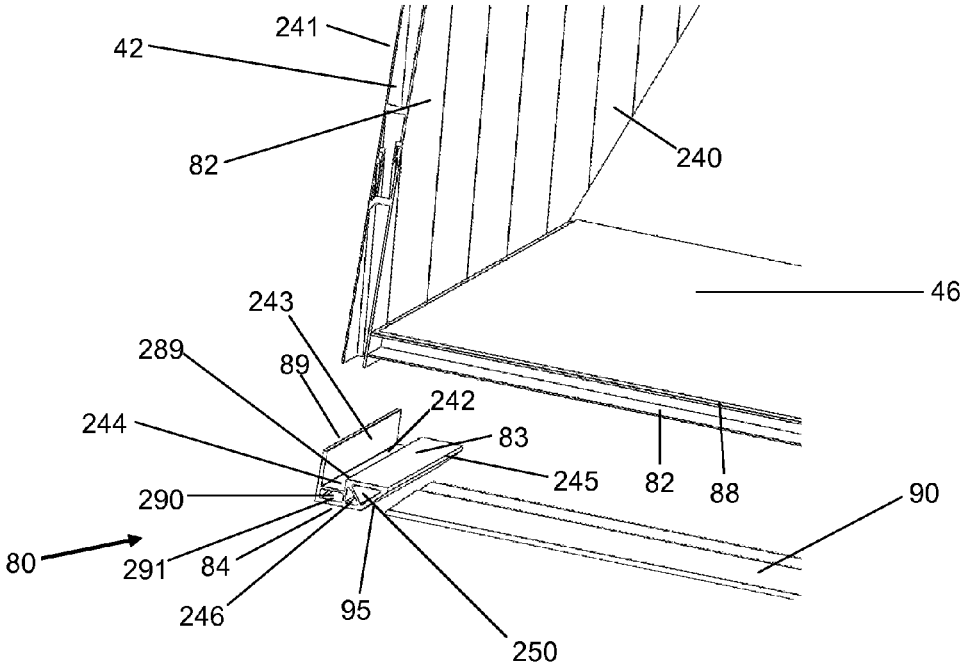

FIGS. 10 and 11 show an enlargement of the bottom portion of the caisson, in order to show a function of the peripheral profile thanks to which the caisson resists the internal pressure of the compacting.

Figure 12:
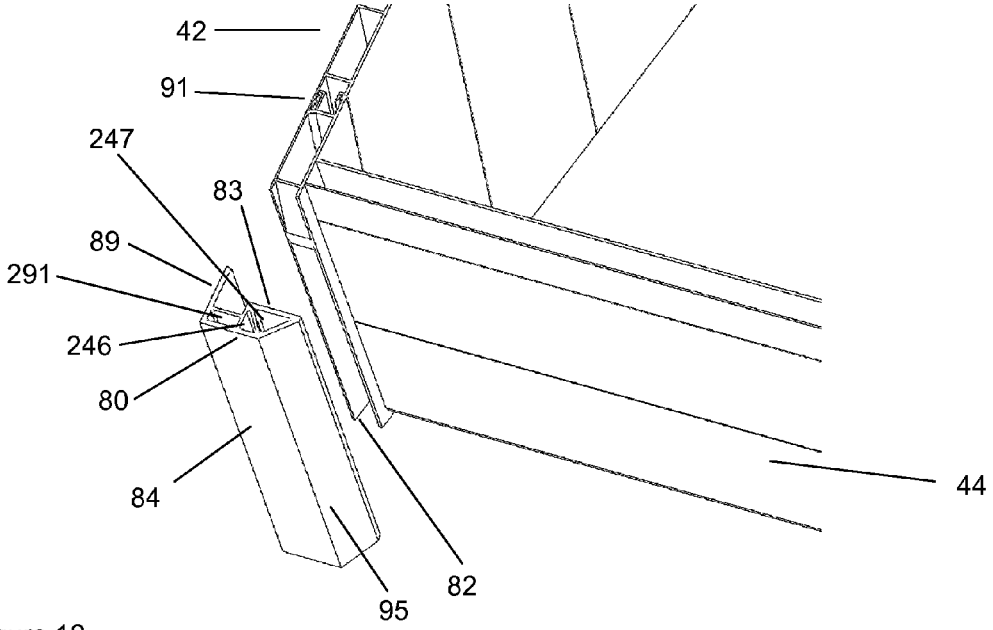

FIG. 12 shows an enlargement of the assembly between the lateral wall and the front wall of the caisson using the peripheral profile.

Figure 13:
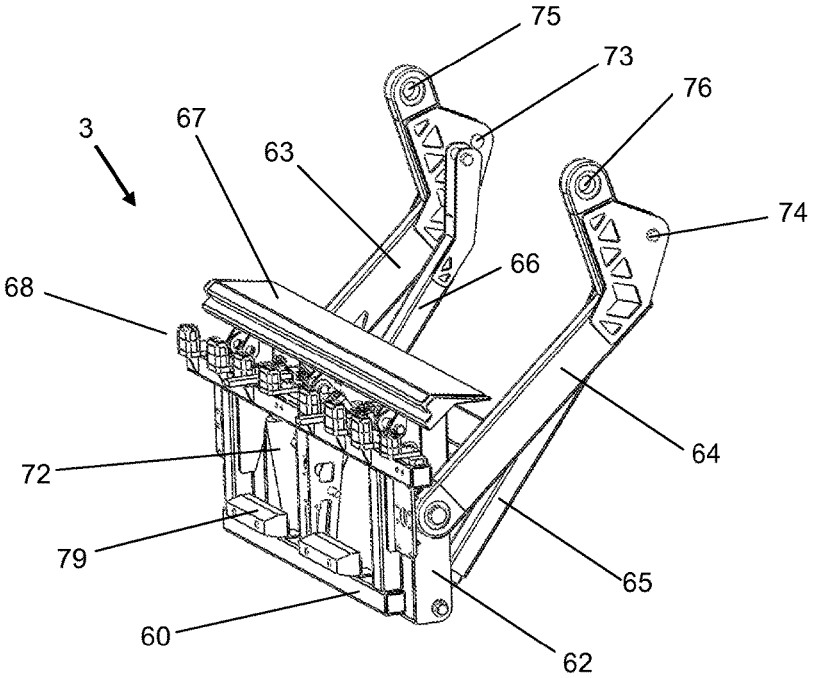
Figure 14:
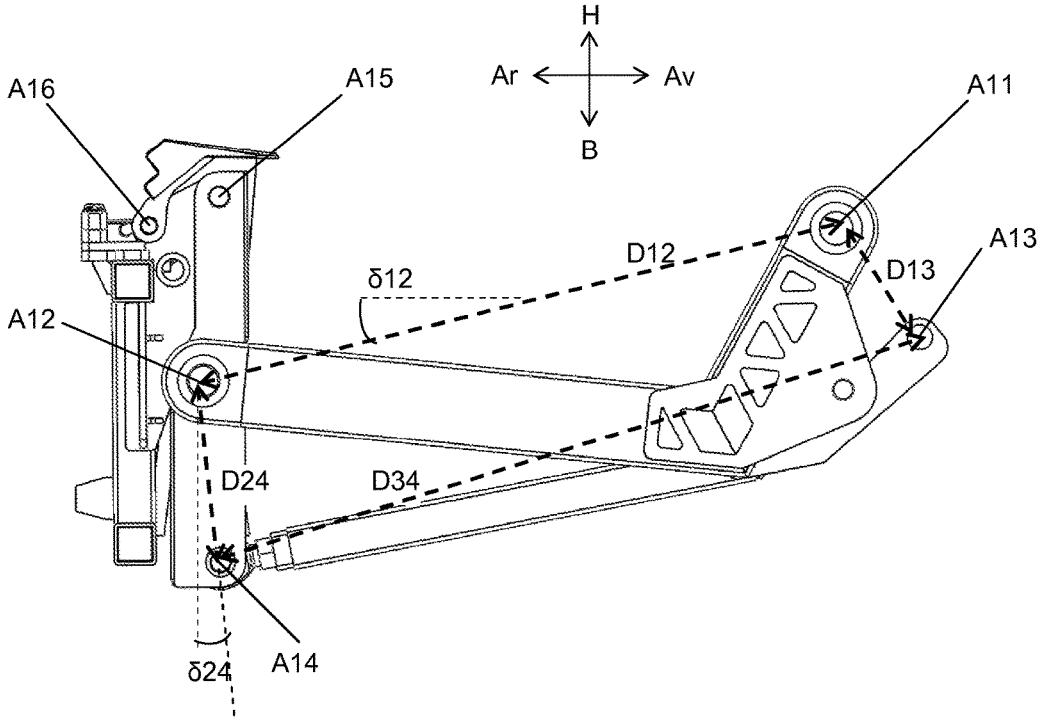

FIGS. 13 and 14 show a container lifter mechanism that has many advantages with an RCV according to the invention.

DESCRIPTION

Figure 1:
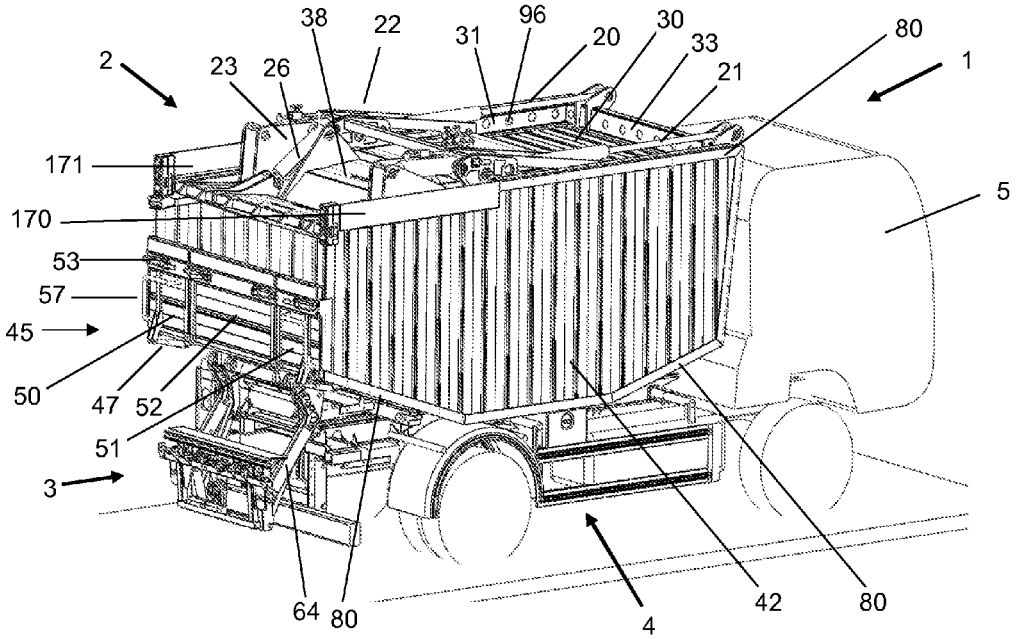
FIGS. 1 to 14 show various embodiments of the invention.

FIG. 1 shows the RCV 1 according to the invention. It typically comprises a chassis 4 with a cab 5 and a superstructure comprising the caisson 2, a container lifter 3 and a compacting mechanism.

In the framework of this invention, it is preferred that the caisson 2, as with any superstructure be as lightened as possible, in order to increase the carrying capacity of the caisson relative to the total weight of the vehicle. However, the RCV 1 has to remain sufficiently rigid and robust. This problem becomes particularly acute when it is decided to use for the superstructure, and in particular for the caisson, materials that are lighter than steel, and in particular aluminum. By way of example, the compacting of the rubbish must be prevented from leading to a deformation of the walls of the caisson.

Figure 2:
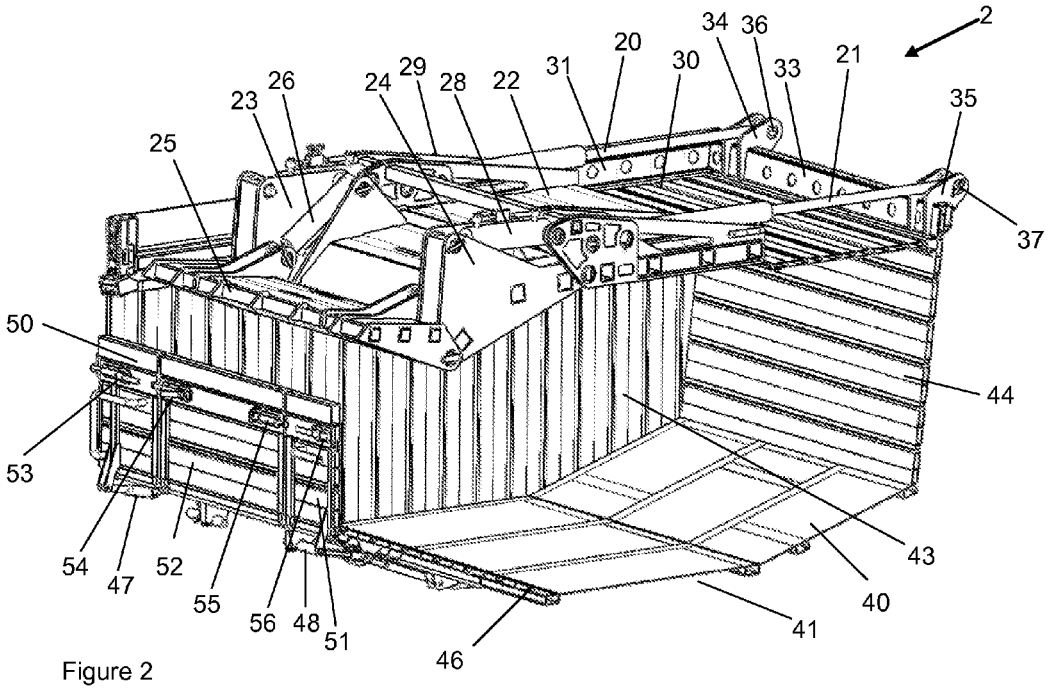

FIG. 2 shows the caisson 2 according to the invention. The bottom of the caisson 2 comprises three portions: a central portion 41, substantially horizontal, a front portion 40 and a rear portion 46. Moreover, the caisson 2 comprises lateral walls 42, 43, a front wall 44 and a swing gate 45 at the rear. The two lateral walls 42, 43 have at their top, respectively, protective strips 170, 171 and sliding members 31, wherein the carrier 22 is intended to slide, and wherein each shoe 160, 161, 162 slides in one of the sliding members 31. The swing gate 45 is designed in order to allow for a manual loading of the vehicle, which offers greater flexibility in use. For this purpose, the swing gate comprises three portions 50, 51, 52. The axis of rotation of the different portions 50, 51, 52 of the swing gate 45 is shared. In manual loading position of the vehicle only the central portion 52 is opened and the lateral portions 50, 51 remain closed. This preserves access for the loaders to the handholds 57, 58. In emptying position, the three portions 50, 51, 52 of the swing gate are folded back using cylinders 47, 48: each cylinder 47, 48 acts only on one of the lateral portions 50, 51, while the force is transmitted to the central portion by the means of locking 54, 55 which have to be actuated manually. A lock 53, 56 between each lateral portion and the flank of the caisson makes it possible to provide better safety against the untimely opening of the swing gate 45 in the situation of collecting rubbish.

In an advantageous embodiment, the caisson is manufactured with semi-finished products made from aluminum alloy. As shown in FIGS. 9 to 12, the lateral walls 42, 43, the front wall 44 and the roof 30 are formed from double-skin panels 82, more preferably, using aluminum alloy profiles designed to be assembled via snap-fitting. These profiles are embedded at the top and at the bottom in a peripheral profile 80 which provides for the transfer of a portion of the forces exerted from the inside by the compacting mechanism on the bottom, on the front and on the top of the caisson to the walls of the caisson 2. In this method of assembly, welding the profiles together in order to provide for the required mechanical rigidity is not needed. However, it can be advantageous to connect them by welding over a height of a few decimeters in order to provide a seal against water and the leachate. This weld seam (not shown in the figures) is carried out between two edges of adjacent profiles. For the same purpose, a continuous weld seam can be carried out between the bottom sheet metal 40, 41, 46 and the lateral and front walls on the inner side of the vehicle. In an advantageous embodiment, the bottom sheet metal 40, 41, 46 does not abut against the elements that constitute the vertical walls 42, 43, 44, but stops a few millimeters from said elements; this makes it possible to connect by a single weld joint the bottom sheet metal 40, 41, 46, the peripheral profile 80 and the elements constituting the vertical walls.

More precisely, the partitions forming the lateral walls 42, 43, the front wall 40 and possibly also the roof 30 comprise: a double-skin wall 42, 43 having two back-to-back outer faces 220, 221; a U-shaped longitudinal reinforcement profile 80 comprising (i.) two sides 89, 289 and a bottom 290 connecting them in such a way as to define a longitudinal slider 222, the sides 89, 289 having facing faces 223, 224 defining the width of the slider 222, and (ii.) a cornice 225 projecting from one of the sides 289, called the inner side, and having an internal bearing surface 83, and are characterized in that the double-skin wall 42, 43 is inserted into the slider 222 in such a way that the outer faces 220, 221 are respectively thrust against the facing faces 223, 224.

The use of aluminum lightens the caisson and as such contributes significantly in achieving the purposes of the invention. The aluminum alloys, judiciously chosen for the use in industrial vehicles, to also resist corrosion very well, knowing that the leachate of the rubbish is in general a particularly corrosive liquid.

The bottom sheet metal 41, 41, 46 is advantageously also made of an aluminum alloy. A peripheral profile 81 made of aluminum alloy surrounds the lateral walls 42, 43 and the front wall 44; it is essential in order to provide for a caisson 2 the mechanical rigidity required to withstand the internal pressure exerted by the compacting mechanism. The roof 30 is fixed. For the front wall 44, the profiles forming the double-wall panels 82 are more preferably positioned with their long direction horizontally, while for the lateral walls 42, 43, they are nested vertically in said peripheral profile 80. The front portion of the bottom of the caisson 46 comprises a double-skin panel (of the same type as that 82 used for the lateral wall 42, 43 of the caisson), and above a piece of sheet metal. The use of aluminum for the walls and the bottom of the caisson allow for easy repair, in particular via welding, damaged zones; there is no need to protect these zones with corrosion-resistant paint, if the alloys chosen are well adapted for use in industrial vehicles.

FIG. 8 shows a view of the top of the vehicle according to the invention, and shows the construction of the scoop and of the carrier. A plurality of traverses (not shown in the figures) are connected by cores (123, 124, 125 for the lower scoop 25, 136, 137, 138 for the upper scoop 38, and 134, 135 for the carrier 22). A plurality of caisson pieces of sheet metal (127, 128, 129) provide torsional rigidity. Note that on each side, the axes of the pallet connecting rod cylinder of the upper scoop 28, 29 and of the lower scoop cylinder 26, 27 are parallel and do not coincide. This embodiment of the invention, which is highly preferred, makes it possible to deploy the force of the cylinders more effectively.

More precisely, the location of these cylinders as "off-center parallel" geometry has several advantages: the angle travelled by each of the scoops is maximized, the forces generated at the end of each scoop is maximized, the forces generated internally at the attachment points 100, 101, 102, of the cylinders are minimized, the attachment points of the cylinders can be positioned in such a way that the forces can be transmitted without an excessive over-sizing of the cylinders. Indeed, in the framework of seeking a lightened RCV, which is maneuverable and of small size which responds to the purposes of the invention, it is sought to be able to use small and light cylinders, which need low hydraulic power and which have a rather short cycle time.

Figure 4:
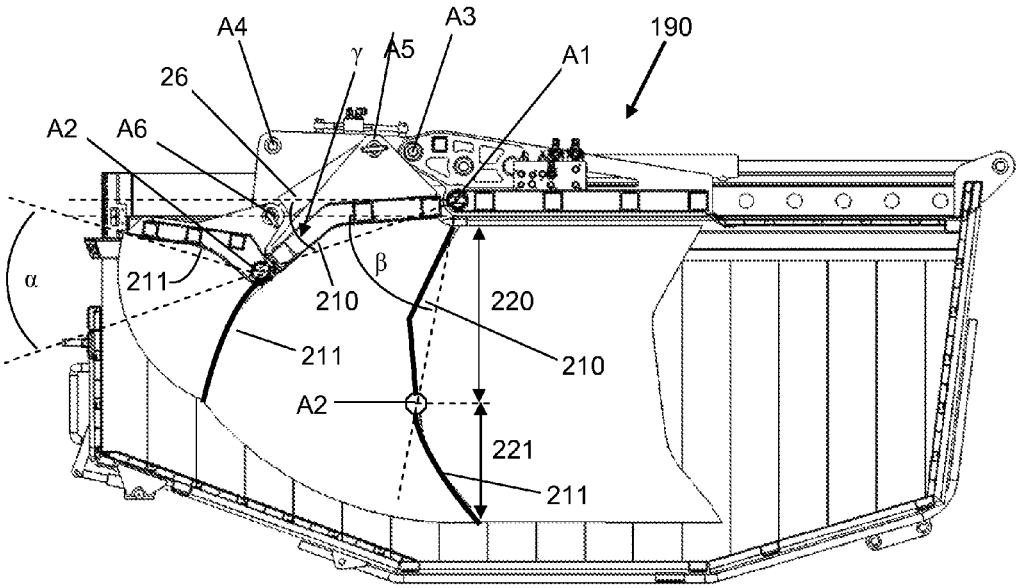

FIG. 5*a* shows an overall view of the compacting mechanism according to the invention, formed by a carrier 22, an upper scoop 38 and a lower scoop 25. The pallet connecting rods 23, 24 have to be integral. FIG. 5*b* indicates six axes marked A1, A2, A3, A4, A5 and A6. FIG. 4 defines the angles alpha, beta and gamma.

Figure 6A:
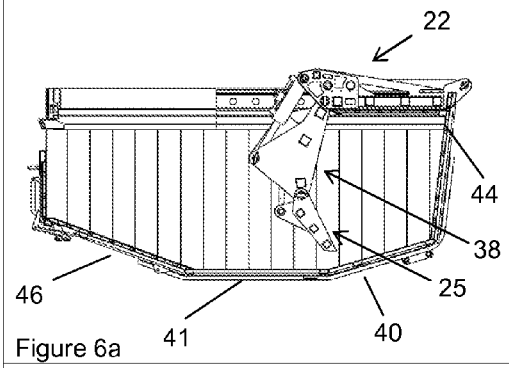
Figure 6B:
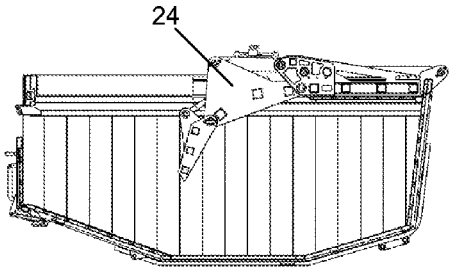
Figure 6C:
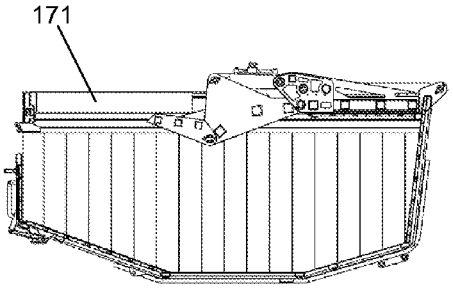
Figure 6D:
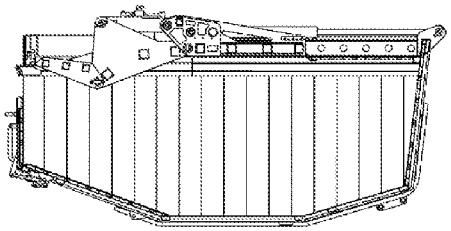
Figure 6E:
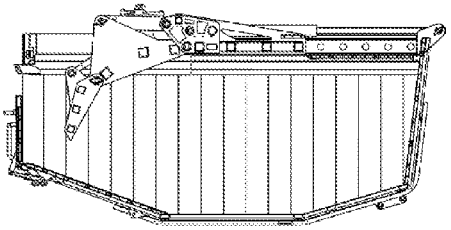

FIGS. 6*a* to 6*h* describe the kinetics of the compacting mechanism during a full cycle. In a starting position (FIG. 6*a*), the carrier 22 is in a position close to the front wall 44; the scoop is in deployed position. Then the upper scoop 38 opens (FIG. 6*b*). Then the lower scoop 25 opens (FIG. 6*c*). Then, the carrier 22 moves backwards (FIG. 6*d*). Then, the lower scoop 25 is deployed (FIG. 6*e*). This can already contribute to the compaction of rubbish if the level of the rubbish is sufficiently high. In a sixth step, the upper scoop 38 is deployed (FIG. 6*f*), leading to a compaction of the rubbish. In a last step, the carrier 22 moves forward (FIG. 6*g*) until a maximum compaction position, which can be, according to the volume of the compacted rubbish, identical to the initial position (FIG. 6*a*) or correspond to a slightly rearwards position.

Figure 6F:
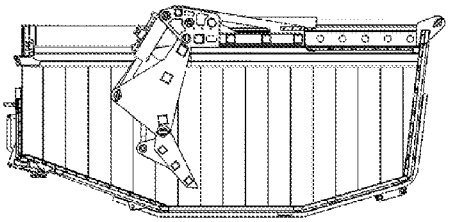
Figure 6G:
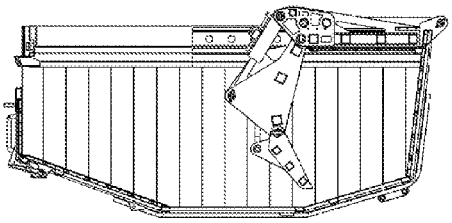
Figure 6H:
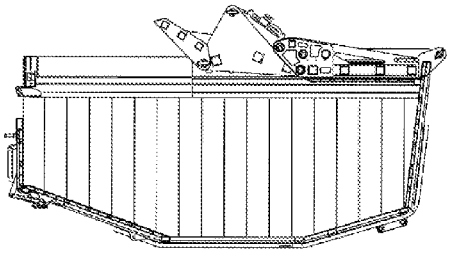

FIG. 6*h* is not part of the compaction cycle, but shows the position of the carrier 22 and of the scoop in emptying position: the carrier 22 is advanced as much as possible and the lower 25 and upper 38 scoops raised to the maximum, in order to not hinder the flow of the rubbish.

For the unloading of the rubbish collected, the caisson 2 is tipped. An ejector is not used. FIG. 7 shows the emptying of the caisson 2. FIG. 7*a* shows the position of the RCV 1 in a position that prepares for the tipping of the caisson 2: note that the swing gate 45 is folded back in such a way that the angle between the plane of said swing gate 45 and the plane of the rear portion 46 of the caisson bottom 2 is approximately 0°. FIG. 7*b* shows the RCV 1 in emptying position, with tipping of the caisson 2. The lift cylinder 150 of the caisson 2 is deployed. At the end of the emptying, if the emptying angle is high, the caisson 2, built from aluminum, may no longer be heavy enough for the downward movement to be initiated by gravity. If the lift cylinder 150 is a single-acting cylinder (which is preferred for reasons of cost), it does not allow for the starting of the return. In this case, a cylinder to assist in the descent 151 must therefore be provided, as shown in FIG. 7*b*, or the emptying angle must be decreased to a value that still allows for the correct emptying of the caisson 2 while still providing for its descent via gravity.

The emptying angle, i.e., the angle between the horizontal and the central portion 41 (horizontal) of the caisson bottom, must be between 55° and 70°, and more preferably between 60° and 70°, and even more preferentially between 62° and 67°. This value is much lower than that used in the RCVs according to prior art (typically 80° to 90°). Choosing a low angle has many advantages. It provides good stability on the ground of the RCV 1 provided with a caisson 2 made of aluminum during emptying. It provides a better distribution of the forces, as the cylinders can be placed further away from the axes, which makes it possible to lighten them and to minimize wear and tear on them. It also provides for a more reliable emptying.

It is the particular geometry of the bottom of the caisson 2 that allows for use with a low emptying angle. More particularly, according to the invention the caisson bottom comprises a front portion 40, a central portion 41 and a rear portion 46, the central portion 41 being approximately horizontal in lowered position, with the front 40 and rear 46 portions being inclined upwards. Preferably, the angle between the plane of the rear portion 46 of the caisson bottom and the central portion 41 of the caisson bottom and between 15° and 25° and more preferably between 17.5° and 22.5°. Advantageously, the front portion 40 and the central portion 41 of the caisson bottom are comprised of a single piece of sheet metal, which is folded in order to form the angle between the two planes. In an alternative, this same sheet metal also forms the rear portion 46 of the caisson bottom, and in this case it also therefore has a second fold in order to form the angle between the rear portion 46 and the central portion 41. If it is sought to minimize the weight of the superstructure, in any case the rear portion 46 of the caisson bottom must be reinforced relative to the front portion 40 and the central portion 41; this can be done by using double-skin panels of the same type of those 82 used for the lateral wall 42, 43 of the caisson.

Figure 3:
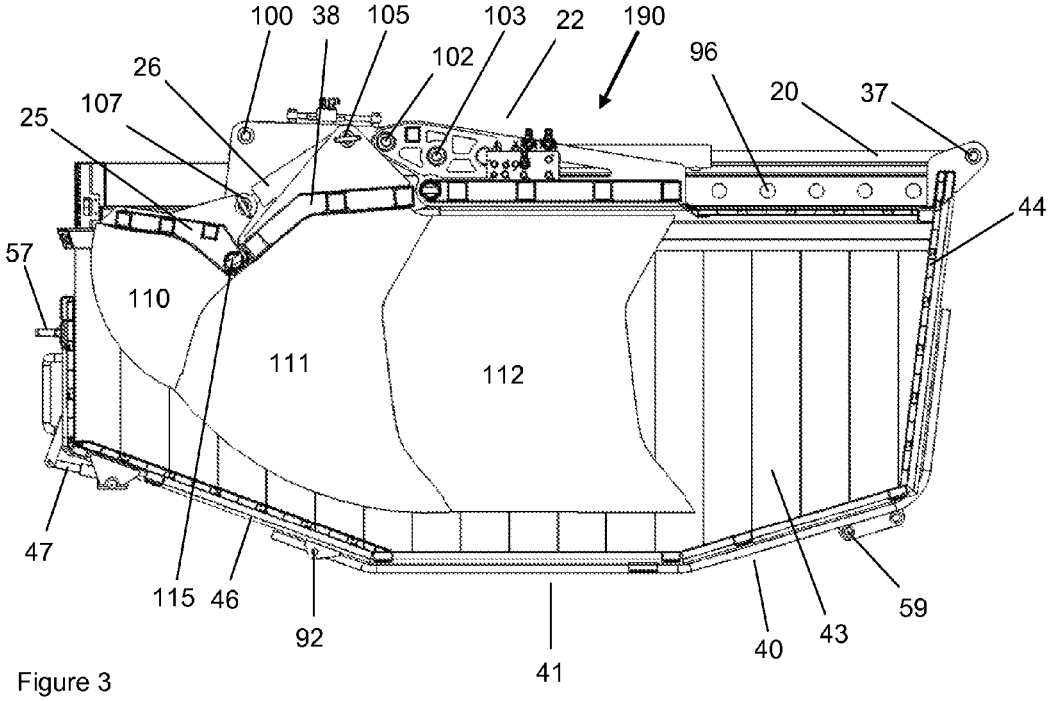

This particular geometry of the caisson makes it possible, in cooperation with the scoop articulated into two portions according to the invention, to sweep a maximum volume of the caisson during the compacting, as shown in FIG. 3 wherein the volume 110 swept by the closing of the lower scoop 25, the volume 111 swept by the closing of the upper scoop 38 and the volume 112 swept by the moving forward of the carrier 22 can be distinguished, with these three steps being executed more preferably successively in the method according to the invention.

As indicated hereinabove, the upper scoop is intended to take a position wherein the axis A2 is pivoted about the axis A1 by an angle beta relative to the forwards-backwards direction, positive upwards and negative downwards, with the angle beta being less than or equal to −50° and more preferably less than or equal to −55°.

The amplitude (or tipping capacity) of the lower scoop, defined by the angle alpha, is more preferably between 75° and 86°, and more preferably between 77° and 86°. The amplitude of the upper scoop (angle beta) is more preferably between 75 and 85°; and more preferably between 77° and 83°.

In an advantageous embodiment, the tipping capacity of the lower scoop ranges from alpha=+29 to −53°, from abutment to abutment. The angle gamma can vary between +4° and −76°. By way of example, the compaction system is advantageously designed in such a way that the angles take on the following values: in the position of FIG. 6*d*: alpha=29°, beta=−5°, gamma=−21°; in the position of FIG. 6*f*: alpha=−53°, beta=−60°, gamma=−76°; and in the position of FIG. 6*h*: alpha=+29°, beta=+20°, gamma=4°.

As such, in this example, the position of the upper scoop varies between the positions shown in FIGS. 6*e* and 6*f* by a beta value of about 55°, and between the FIGS. 6*h* and 6*f* or 6*g* by a value of about 80°.

In "collection" mode (FIG. 6*d*), the lower scoop is advantageously always in an upper abutment position and the upper scoop in a position referred to as high collection position. During the loading and transporting of rubbish, the roof 30, the carrier 22 and the scoop protect the rubbish from blowing away. It is advantageous to add protective strips 170, 171 in order to prevent the rubbish from blowing away during loading; they are more preferably made of transparent Plexiglas in order to not hinder the visibility of the loaders.

According to an advantageous embodiment, the mechanical parts of the scoop and of the carrier (except for the cylinders and their rods) are made using wrought aluminum semi-finished parts. This applies in particular to the cores. The sliding carrier 22 is provided on each side with guide shoes 160 which slide on the lower zone 93 and the upper bearing zone 94 of the carrier shoes of the slide profile 85; said shoes extend more preferably over the entire length of the carrier. The lateral guiding is provided by a plurality of lateral bearing shoes 161, 162 that cooperate with the lateral surface of the guide rail 81. Typically, the guide shoes 160 are strips made from a suitable plastic of a length of about 100 cm and of a width of about 5 cm. This construction allows for an excellent distribution of the loads over the bearing surface, which is important especially when the slider profile 85 is made of aluminum, a metal that is sensitive to matting.

The compacting mechanism 190 according to the invention further comprises on each side at least one bearing shoe 160, 163, more preferably at the top and at the bottom, and at least one lateral guide shoe 161, 162 fixed to the carrier 22 and intended to cooperate with the frame 2 in order to guide the carrier 22 in its movement. More precisely, and preferably, it comprises on each side at least one upper bearing shoe 160 that cooperates with the upper bearing zone 94 of the carrier shoes, and at least one lower bearing shoe 163 that cooperates with the lower bearing zone 93 of the carrier shoes. The lateral bearing shoes 161, 162 cooperate with the surface of the lateral guide rail 81 with the purpose of laterally stabilizing the forward and backward movement of the sliding carrier 22.

The RCV according to the invention can be provided with container lifting system of a known type, but it is preferred that the projection of the functional zone on the horizontal be small, in order to not destabilize the RCV, and in order to reduce its encumbrance during operation. FIGS. 13 and 14 show a container lifting system 3 which is particularly adapted to the caisson 2 according to the invention.

This container lifter system 3 comprises at least one main arm 63, 64 intended to be pivotably mounted on a chassis 4 about a first right-left axis, called the axis A11, intended to take a low position and a high position relative to a bottom-top direction, a framework 61, 62 pivotably mounted on said main arm 63, 64 about a second right-left axis, called the axis A12, a seat 60 mounted on the framework 61, 62 and intended to receive a container in order to lift it, at least one auxiliary arm 65, 66 intended to be pivotably mounted on the chassis 4 about a third right-left axis, called the axis A13, and pivotably mounted on the framework about a fourth right-left axis, called the axis A14, said container lifting system characterized in that the distance between the axes Al2 and A14 (D24) is greater than the distance between the axes A11 and A13 (D13).

Advantageously, the distance between the axes A12 and A14 (D24) is greater by at least 10% of the distance between the axes A11 and A13 (D13), more preferably by at least 20%, and even more preferably by at least 30%. This container lifting system makes it possible to reduce the size of the functional zone, and it makes it possible to lighten the tipping system for heavy containers.

By way of example, a caisson has been carried out provided with a system of compaction according to the invention. For a capacity of the RCV of about 8.5 m3, the volume swept by the scoop (i.e. the sum of the volumes 110, 111, 112) was about 4.5 m3. Its carrying capacity in waste was greater than 3 tons. The height of the zone not swept by the lower edge of the lower scoop is advantageously about from 15 to 20 cm, in order to prevent the binding of the scoop on the non-compressible dense rubbish. This caisson can be mounted on mass-produced truck chassis, designed typically for a gross vehicle weight rating (GVWR) from 7.5 to 9 tons. RCVs according to prior art, with a vehicle made of steel, require a chassis designed for a GVWR of at least 10 t in order to be able to have a carrying capacity of about 3 tons (typically associated with a volume utile of 8.5 m3), The sheet metal of the bottom of the caisson has a thickness of 4 mm (standard AG3 alloy). The peripheral profile was made from aluminum alloy AA 6106 T6. The profiles forming the double-skin panels for the lateral and front walls and for the rear panel of the bottom of the caisson had a length of 200 mm and a thickness of 30 mm. For the roof, a thickness of 25 mm was sufficient, still with the purpose of lightening the superstructure.

LIST OF REFERENCE NUMERALS

| | |
|---|---|
| 1 | Rubbish collection vehicle |
| 2 | Caisson |
| 3 | Container lifter |
| 4 | Chassis |
| 5 | Cab |
| 20, 21 | Carrier cylinder |
| 22 | Sliding carrier |
| 23, 24 | Pallet connecting rod |
| 25 | Lower scoop |
| 26, 27 | Lower scoop cylinder |
| 28, 29 | Pallet connecting rod cylinder of the upper scoop |
| 30 | Roof |
| 31, 32 | Sliding member |
| 33 | Front slider |
| 34, 35 | Fixation of the carrier cylinder |
| 36, 37 | Axis of the carrier cylinder |
| 38 | Upper scoop |
| 40 | Caisson bottom (front portion) |
| 41 | Caisson bottom (central portion) |
| 42, 43 | Lateral wall |
| 44 | Front wall |
| 45 | Swing gate |
| 46 | Caisson bottom (rear portion) |
| 47, 48 | Swing gate cylinder |

-continued

| LIST OF REFERENCE NUMERALS | |
|---|---|
| 50, 51 | Lateral portion of the swing gate |
| 52 | Central portion of the swing gate |
| 53, 54, 55, 56 | Manual means of locking |
| 57, 58 | Handhold |
| 59 | Articulation point for the caisson lift cylinder |
| 60 | Seat |
| 61, 62 | Riser |
| 63, 64 | Main arm |
| 65, 66 | Auxiliary arm |
| 67 | Clamp |
| 68 | Comb |
| 72 | Rotation cylinder |
| 73, 74 | Attachment point for the lift cylinder |
| 75, 76 | Attachment point for the rotation of the main arm |
| 79 | Lower abutment of the seat |
| 80 | Peripheral profile |
| 81 | Lateral guide rail |
| 82 | Double-skin panel |
| 83 | Internal bearing surface |
| 84 | External bearing surface |
| 85 | Slide profile |
| 86 | Reinforcement bulge |
| 87 | Surface of the connection with the wall |
| 88 | Floor sheet metal |
| 89 | Outer edge |
| 90 | Traverse |
| 91 | Mechanical interconnecting means |
| 93 | Lower bearing zone of the carrier shoes |
| 94 | Upper bearing zone of the carrier shoes |
| 95 | Slanted bearing surface |
| 96 | Cap weld zone |
| 100 | Attachment point of the cylinder of the upper scoop and on the upper scoop |
| 102 | Attachment point of the cylinder of the upper scoop on the carrier |
| 103 | Attachment point of the carrier cylinder on the carrier |
| 105 | Attachment point of the lower scoop cylinder on the upper scoop |
| 107 | Attachment point of the cylinder of the lower scoop on the lower scoop |
| 110 | Volume swept by the closing of the lower scoop |
| 111 | Volume swept by the closing of the upper scoop |
| 112 | Volume swept by the forward movement of the carrier |
| 115 | Rotation point of the lower scoop relative to the upper scoop |
| 123, 124, 125 | Core |
| 127, 128, 129 | Caisson sheet metal |
| 134-138 | Core |
| 150 | Lift cylinder of the caisson |
| 151 | Descent assist cylinder |
| 160 | Upper bearing shoe |
| 161, 162 | Lateral bearing shoe |
| 163 | Lower bearing shoe |
| 170, 171 | Protective strips |
| 190 | Compacting system |
| 210 | Upper milling face |
| 211 | Lower milling face |
| 220 | Projection of the upper milling face |
| 221 | Projection of the lower milling face |
| 240 | Outer face of the inner skin |
| 241 | Outer face of the external skin |
| 242 | Slider of the reinforcement profile 80 |
| 243, 244 | Face facing the slider 242 |
| 245 | Cornice |
| 250 | Cell separation wall |
| 289 | Inner side of the slider |
| 290 | Bottom of the slider |
| 291 | Longitudinal cell of the bottom |
| 300 | Upper side of the slider profile 85 |
| 301 | Lower side of the slider profile 85 |
| 302 | Bottom of the slider profile 85 |
| 303 | Slider of the slider profile 85 |
| 304 | Lower lug |

The letters A1, A2, A3, A4, A5, A6, A11, A12, A13, A14, A15 and A16 designate axes. The letters D12, D13, D24 and D34 designate the distances between axes.

What is claimed is:

1. A system for compacting rubbish, comprising:

a frame having a front wall;

a carrier to be moved in forwardly and rearwardly directions relative to the frame;

at a top and at a bottom of the carrier, at least one bearing shoe, and at least one lateral guide shoe fixed to the carrier, and which is to cooperate with the frame in order to guide the carrier in its movement;

an upper scoop pivotably mounted to the carrier about a first horizontal axis, and having an upper face to mill the rubbish, the upper face having a first projection, the upper scoop being moveable to take a downwardly deployed position when the upper face is facing the front wall; and a lower scoop pivotably mounted to the upper scoop about a second horizontal axis, and having a lower face to mill the rubbish, the lower face having a second projection, the lower scoop being moveable to take a downwardly deployed position when the lower face is facing the front wall such that the first projection, in a transverse plane relative to the forwardly and rearwardly directions, has a surface greater than or equal to the second projection in the transverse plane, wherein the carrier is moveable in the forwardly direction when the upper scoop and the lower scoop is respectively in the deployed position, in such a way as to compact the rubbish between the upper and lower faces and the front wall.

2. The system of claim 1, wherein, in the deployed position, the first projection in the transverse plane has a surface between one and one and a half times the surface of the second projection in the transverse plane.

3. The system of claim 1, wherein:

the upper scoop is to take a position in which the second horizontal axis is pivoted about the first horizontal axis by an angle $\gamma$ relative to the forwardly and rearwardly directions, positive upwards and negative downwards, the angle $\gamma$ being greater than or equal to $-25°$; and in a high position of the lower scoop, a rear end of the lower face is to be pivoted by an angle $\alpha$ relative to the plane defined by the first and second horizontal axes, positive upwards and negative downwards, with the angle $\alpha$ being between 25° and 35°.

4. The system of claim 1, wherein the upper scoop is to take a position wherein the second horizontal axis is pivoted about the first horizontal axis by an angle $\beta$ relative to the forwards-backwards direction, positive upwards and negative downwards, with the angle $\beta$ being less than $-55°$.

5. The system of claim 1, wherein the carrier, the upper scoop, and the lower scoop are made more than 95% by weight from aluminum.

6. A rubbish collection vehicle, comprising:

a caisson to store the rubbish, the caisson having a front wall;

a system to compact the rubbish stored in the caisson, the system having:

a frame formed by the caisson;

a carrier to be moved in forwardly and rearwardly directions relative to the frame;

at a top and at a bottom of the carrier, at least one bearing shoe, and at least one lateral guide shoe fixed to the carrier, and which is to cooperate with the frame in order to guide the carrier in its movement;

an upper scoop pivotably mounted to the carrier about a first horizontal axis, and having an upper face to mill the rubbish, the upper face having a first projection, the upper scoop being moveable to take a downwardly deployed position when the upper face is facing the front wall; and a lower scoop pivotably mounted to the upper scoop about a second horizontal axis, and having a lower face to mill the rubbish, the lower face having a second projection, the lower scoop being moveable to take a downwardly deployed position when the lower face is facing the front wall such that the first projection, in a transverse plane relative to the forwardly and rearwardly directions, has a surface greater than or equal to the second projection in the transverse plane, wherein the carrier is moveable in the forwardly direction when the upper scoop and the lower scoop is respectively in the deployed position, in such a way as to compact the rubbish between the upper and lower faces and the front wall.

7. The rubbish collection vehicle of claim 6, wherein the caisson is made more than 95% by weight of aluminum.

8. The rubbish collection vehicle of claim 6, wherein lateral walls of the caisson comprise double-skin aluminum profiles.

9. The rubbish collection vehicle of claim 6, wherein a bottom of the caisson is made from aluminum sheet metal.

10. The rubbish collection vehicle of claim 6, wherein the caisson is edged with an aluminum peripheral profile.

11. The rubbish collection vehicle of claim 6, wherein:

the caisson comprises lateral walls having at a top respectively thereof sliding members to permit the carrier to moveably slide; and each shoe slides in one of the sliding members.

12. The rubbish collection vehicle of claim 6, wherein the caisson comprises a bottom having a central portion, and a rear portion inclined with an angle of inclination relative to the horizontal between 17° and 23°.

13. The rubbish collection vehicle of claim 6 wherein:

the upper scoop is to take a position in which the second horizontal axis is pivoted about the first horizontal axis by an angle $\gamma$ relative to the forwardly and rearwardly directions, positive upwards and negative downwards, the angle $\gamma$ being greater than or equal to −25°; and in a high position of the lower scoop, a rear end of the lower face is to be pivoted by an angle $\alpha$ relative to the plane defined by the first and second horizontal axes, positive upwards and negative downwards, with the angle $\alpha$ being between 25° and 35°.

14. The rubbish collection vehicle of claim 6, wherein the upper scoop is to take a position wherein the second horizontal axis is pivoted about the first horizontal axis by an angle $\beta$ relative to the forwards-backwards direction, positive upwards and negative downwards, with the angle $\beta$ being less than −55°.

15. The rubbish collection vehicle of claim 6, wherein wherein, in the deployed position, the first projection in the transverse plane has a surface between one and one and a half times the surface of the second projection in the transverse plane.

16. A system for compacting rubbish, comprising:

a frame having a front wall;

a carrier to be moved in forwardly and rearwardly directions relative to the frame;

at least one first cylinder to actuate the carrier, and having a rear end fixed to a rear of the carrier and a front end to be fixed to the frame in front of the carrier;

an upper scoop pivotably mounted to the carrier about a first horizontal axis, and having an upper face to mill the rubbish, the upper face having a first projection, the upper scoop being moveable to take a downwardly deployed position when the upper face is facing the front wall;

at least one second cylinder to actuate the upper scoop, and having a front end pivotably mounted to the carrier about a third horizontal axis spatially higher than the first horizontal axis, and a rear end pivotably mounted to the upper scoop about a fourth horizontal axis spatially higher than the second horizontal axis;

a lower scoop pivotably mounted to the upper scoop about a second horizontal axis, and having a lower face to mill the rubbish, the lower face having a second projection, the lower scoop being moveable to take a downwardly deployed position when the lower face is facing the front wall such that the first projection, in a transverse plane relative to the forwardly and rearwardly directions, has a surface greater than or equal to the second projection in the transverse plane; and at least one third cylinder to actuate the lower scoop, and having a front end pivotably mounted to the upper scoop about a fifth horizontal axis spatially higher than the second horizontal axis and located in front of the fourth horizontal axis, and a rear end pivotably mounted to the lower scoop about a sixth horizontal axis, wherein the carrier is moveable in the forwardly direction when the upper scoop and the lower scoop is respectively in the deployed position, in such a way as to compact the rubbish between the upper and lower faces and the front wall.

17. A rubbish collection vehicle, comprising:

a caisson to store the rubbish, the caisson having a front wall;

a system to compact the rubbish stored in the caisson, the system having:

a frame formed by the caisson;

a carrier to be moved in forwardly and rearwardly directions relative to the frame;

at least one first cylinder to actuate the carrier, and having a rear end fixed to a rear of the carrier and a front end to be fixed to the frame in front of the carrier;

an upper scoop pivotably mounted to the carrier about a first horizontal axis, and having an upper face to mill the rubbish, the upper face having a first projection, the upper scoop being moveable to take a downwardly deployed position when the upper face is facing the front wall;

at least one second cylinder to actuate the upper scoop, and having a front end pivotably mounted to the carrier about a third horizontal axis spatially higher than the first horizontal axis, and a rear end pivotably mounted to the upper scoop about a fourth horizontal axis spatially higher than the second horizontal axis;

a lower scoop pivotably mounted to the upper scoop about a second horizontal axis, and having a lower face to mill the rubbish, the lower face having a second projection, the lower scoop being moveable to take a downwardly deployed position when the lower face is facing the front wall such that the first projection, in a transverse plane relative to the forwardly and rearwardly directions, has a surface greater than or equal to the second projection in the transverse plane; and at least one third cylinder to actuate the lower scoop, and having a front end pivotably mounted to the upper scoop about a fifth horizontal axis spatially higher than the second horizontal axis and located in front of the fourth horizontal axis, and a rear end pivotably mounted to the lower scoop about a sixth horizontal axis, wherein the carrier is moveable in the forwardly direction when the upper scoop and the lower scoop is respectively in the deployed position, in such a way as to compact the rubbish between the upper and lower faces and the front wall.

* * * * *